US008210651B2

(12) United States Patent
Silverbrook

(10) Patent No.: US 8,210,651 B2
(45) Date of Patent: Jul. 3, 2012

(54) MODULAR PRINTHEAD INCORPORATING ALIGNMENT MECHANISM FOR PRINTHEAD MODULE

(75) Inventor: Kia Silverbrook, Balmain (AU)

(73) Assignee: Zamtec Limited, Dublin (IE)

( * ) Notice: Subject to any disclaimer, the term of this patent is extended or adjusted under 35 U.S.C. 154(b) by 207 days.

(21) Appl. No.: 12/709,507

(22) Filed: Feb. 21, 2010

(65) Prior Publication Data

US 2010/0149269 A1 Jun. 17, 2010

Related U.S. Application Data

(63) Continuation of application No. 10/986,813, filed on Nov. 15, 2004, now Pat. No. 7,669,965, which is a continuation of application No. 10/804,048, filed on Mar. 19, 2004, now Pat. No. 7,322,675, which is a continuation of application No. 10/636,286, filed on Aug. 8, 2003, now Pat. No. 6,739,701, which is a continuation of application No. 10/129,433, filed as application No. PCT/AU01/00217 on Mar. 2, 2001, now Pat. No. 6,672,707.

(30) Foreign Application Priority Data

Mar. 2, 2000 (AU) ..... PQ5957

(51) Int. Cl.
*B41J 2/14* (2006.01)

(52) U.S. Cl. ..... 347/49

(58) Field of Classification Search ..... 347/13, 347/42, 49

See application file for complete search history.

(56) References Cited

U.S. PATENT DOCUMENTS

| | | | |
|---|---|---|---|
| 5,016,023 | A | 5/1991 | Chan et al. |
| 5,057,854 | A | 10/1991 | Pond et al. |
| 5,148,194 | A | 9/1992 | Asai et al. |
| 5,160,945 | A | 11/1992 | Drake |
| 5,297,017 | A | 3/1994 | Haselby et al. |
| 5,488,397 | A | 1/1996 | Nguyen et al. |
| 5,696,541 | A | 12/1997 | Akahane et al. |
| 5,850,240 | A | 12/1998 | Kubatzki et al. |
| 6,000,782 | A | 12/1999 | Lee et al. |
| 6,068,367 | A | 5/2000 | Fabbri |
| 6,270,184 | B1 | 8/2001 | Igarashi et al. |

(Continued)

FOREIGN PATENT DOCUMENTS

| | | | |
|---|---|---|---|
| EP | 0379151 | A | 7/1990 |
| EP | 0391570 | A | 10/1990 |
| EP | 1000744 | A | 5/2000 |

*Primary Examiner* — Lamson Nguyen

(74) *Attorney, Agent, or Firm* — Cooley LLP

(57) ABSTRACT

A modular printhead includes a chassis; a plurality of printhead modules mounted in the chassis; a plurality of alignment mechanisms each corresponding to a respective printhead modules, each alignment mechanism being interposed between the chassis and a respective printhead module, each alignment mechanism including a lever provided on a first side of a fulcrum point of the lever and a printhead module engagement plate coupled to the lever at a second side of the fulcrum point; a plurality of adjuster blocks corresponding to respective alignment mechanisms, each adjuster block engaged with respective levers via an aperture defined through each lever; and a plurality of adjustment mechanisms corresponding to respective adjuster blocks, each adjustment mechanism coupled to the chassis at one end and to a respective adjuster block at another end. The lever and the printhead module engagement plate are formed as a unitary piece. Each alignment mechanism further includes a number of hinged arms facilitating linear and parallel movement of the engagement plate in a direction towards and away from adjacent printhead modules in response to operation of the adjustment mechanism.

4 Claims, 7 Drawing Sheets

U.S. PATENT DOCUMENTS 6,290,332 B1 9/2001 Crystal et al.
6,575,557 B2 6/2003 Tominaga
6,672,707 B2 1/2004 Silverbrook
6,962,410 B2 11/2005 Silverbrook et al.
7,669,965 B2 * 3/2010 Silverbrook ..... 347/42
2002/0024554 A1 2/2002 Tominaga

* cited by examiner

MODULAR PRINTHEAD INCORPORATING ALIGNMENT MECHANISM FOR PRINTHEAD MODULE

CROSS-REFERENCE TO RELATED APPLICATIONS

The present Application is a Continuation of U.S. application Ser. No. 10/804,048 filed on Mar. 19, 2004, now issued U.S. Pat. No. 7,322,675, which is a Continuation of U.S. application Ser. No. 10/636,286, filed on Aug. 8, 2003, now issued U.S. Pat. No. 6,739,701, which is a Continuation of U.S. application Ser. No. 10/129,433, filed on May 6, 2002, now issued U.S. Pat. No. 6,672,707, which is a national phase of PCT/AU01/00217, filed on Mar. 2, 2001.

CO-PENDING APPLICATIONS

Various methods, systems and apparatus relating to the present invention are disclosed in the following co-pending applications filed by the applicant or assignee of the present invention on May 24, 2000.

| | | | |
|---|---|---|---|
| PCT/AU00/00578 | PCT/AU00/00579 | PCT/AU00/00581 | PCT/AU00/00580 |
| PCT/AU00/00582 | PCT/AU00/00587 | PCT/AU00/00588 | PCT/AU00/00589 |
| PCT/AU00/00583 | PCT/AU00/00593 | PCT/AU00/00590 | PCT/AU00/00591 |
| PCT/AU00/00592 | PCT/AU00/00584 | PCT/AU00/00585 | PCT/AU00/00586 |
| PCT/AU00/00594 | PCT/AU00/00595 | PCT/AU00/00596 | PCT/AU00/00597 |
| PCT/AU00/00598 | PCT/AU00/00516 | PCT/AU00/00517 | PCT/AU00/00511 |

The disclosures of these co-pending applications are incorporated herein by cross-reference. Also incorporated by cross-reference, is the disclosure of a co-filed PCT application, PCT/AU01/00216 (deriving priority from Australian Provisional Patent Application No. PQ5959).

FIELD OF THE INVENTION

The present invention relates to inkjet printers and in particular to pagewidth inkjet printers.

BACKGROUND

The printheads used by inkjet printers traditionally traverse back and forth within the printer as a page is fed past the printhead. To increase printing speed, pagewidth printheads have been developed so that the printhead does not need to traverse across the page.

For a number of reasons, it is relatively expensive to produce pagewidth printheads in a unitary form. Therefore, to minimize costs it is preferable to produce a modular pagewidth printhead made up of a series of printhead modules.

It is necessary to align each module so that the printing from one module precisely abuts the printing from the adjacent modules. For most types of printing, it is sufficient to electronically align the modules. This is done by configuring the modules such that they slightly overlap with each other, and then digitally adjusting the printing from each module for a smooth transition of the print data.

Unfortunately, this requires complex manipulation of the print data allocated to the respective modules. The digital controller for the printer needs to be relatively powerful to accommodate this and the associated costs can be prohibitive for the SOHO (small office/home office) market.

SUMMARY

According to one aspect of the present disclosure, a modular printhead includes a chassis; a plurality of printhead modules mounted in the chassis; a plurality of alignment mechanisms each corresponding to a respective printhead modules, each alignment mechanism being interposed between the chassis and a respective printhead module, each alignment mechanism including a lever provided on a first side of a fulcrum point of the lever and a printhead module engagement plate coupled to the lever at a second side of the fulcrum point; a plurality of adjuster blocks corresponding to respective alignment mechanisms, each adjuster block engaged with respective levers via an aperture defined through each lever; and a plurality of adjustment mechanisms corresponding to respective adjuster blocks, each adjustment mechanism coupled to the chassis at one end and to a respective adjuster block at another end. The lever and the printhead module engagement plate are formed as a unitary piece. Each alignment mechanism further includes a number of hinged arms facilitating linear and parallel movement of the engagement plate in a direction towards and away from adjacent printhead modules in response to operation of the adjustment mechanism.

BRIEF DESCRIPTION OF THE DRAWINGS

A preferred embodiment of the invention will now be described by way of example only with reference to the accompanying drawings in which.

DETAILED DESCRIPTION OF THE PREFERRED EMBODIMENTS

Figure 1:
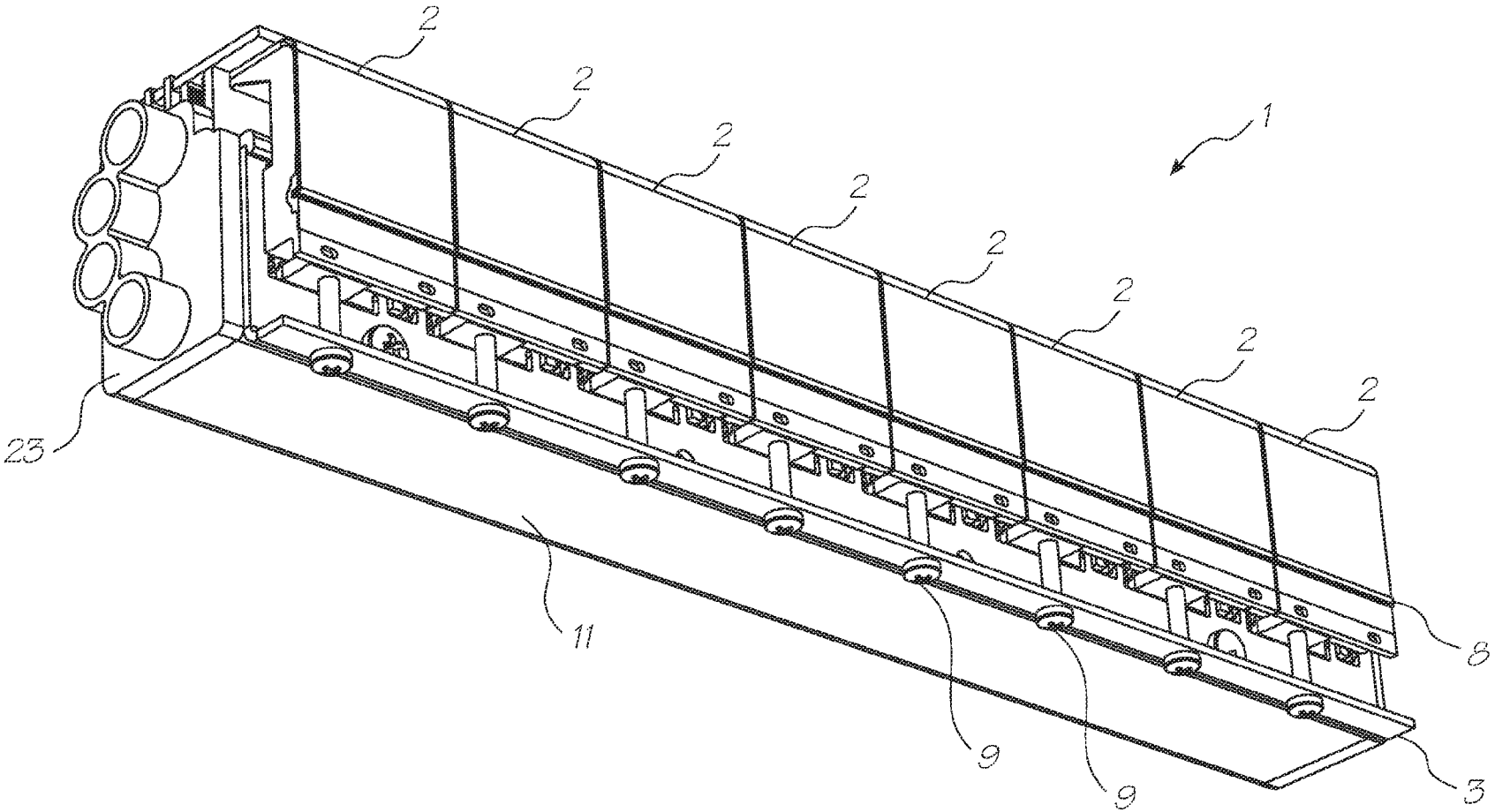
FIG. 1 shows a perspective view of the underside of a modular printhead according to the present invention.
Figure 2:
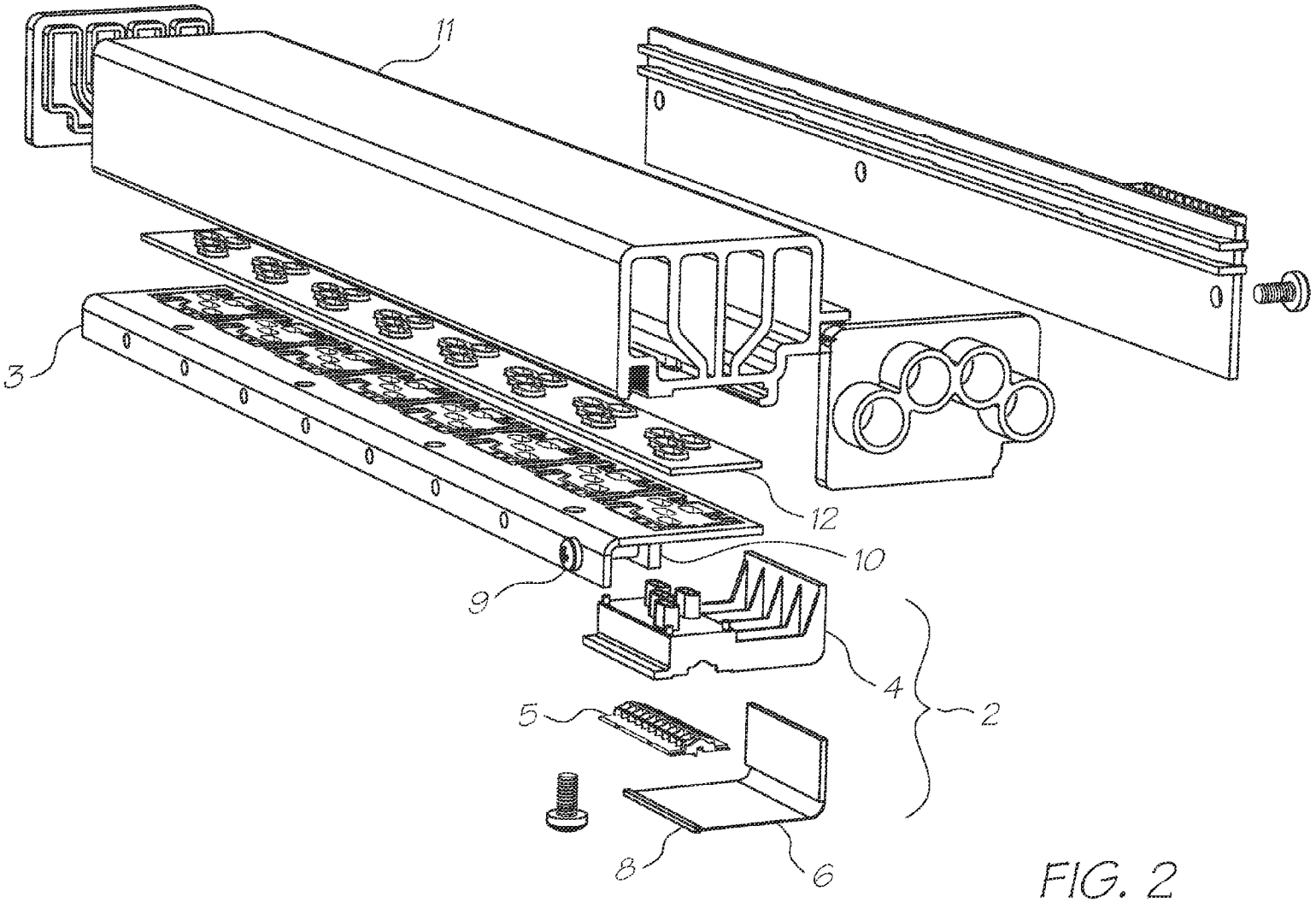
FIG. 2 shows an exploded perspective view of the modular printhead shown in FIG. 1.

Referring to the figures, the modular printhead (1) includes a plurality of printhead modules (2) mounted to a metal chassis (3) which acts as a support frame. The modules (2) are sealed units with four independent ink chambers that feed the inkjet nozzles in a printhead chip (8). As best seen in FIG. 2, each printhead module (2) is plugged into a reservoir moulding (11) that supplies the ink through a self sealing elastomeric strip (12). The entire modular printhead (1) may itself be a module of a larger printhead having two levels of modularity. Accordingly, the length of the overall printhead is arbitrary.

Figure 7:
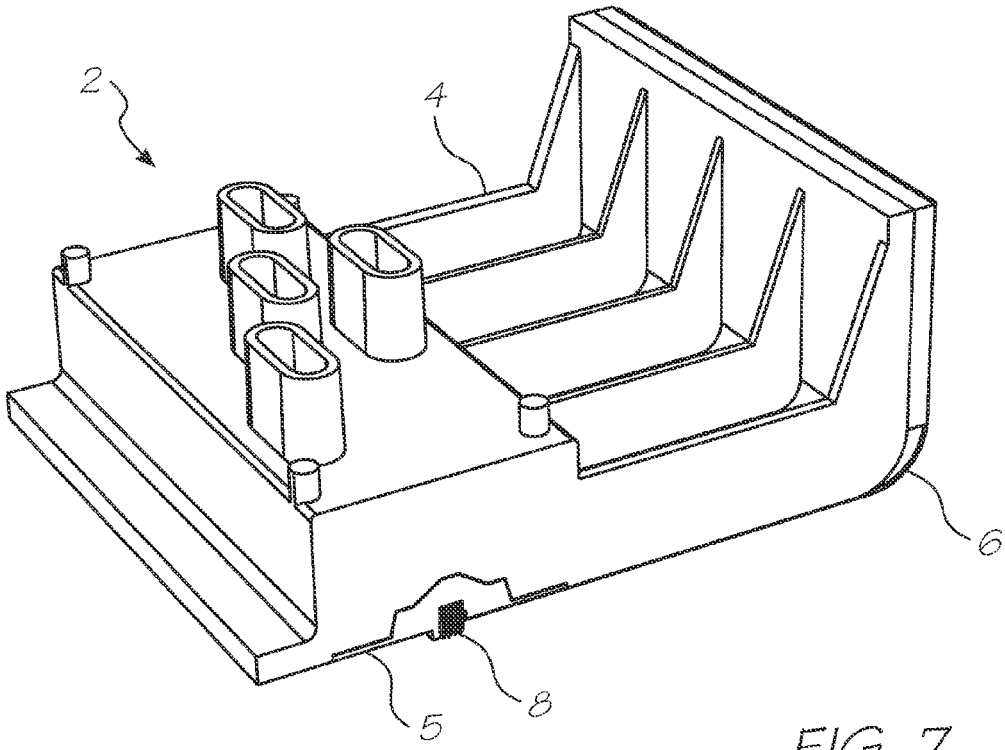
FIG. 7 is a perspective view showing the top and side of a printhead module.
Figure 8:
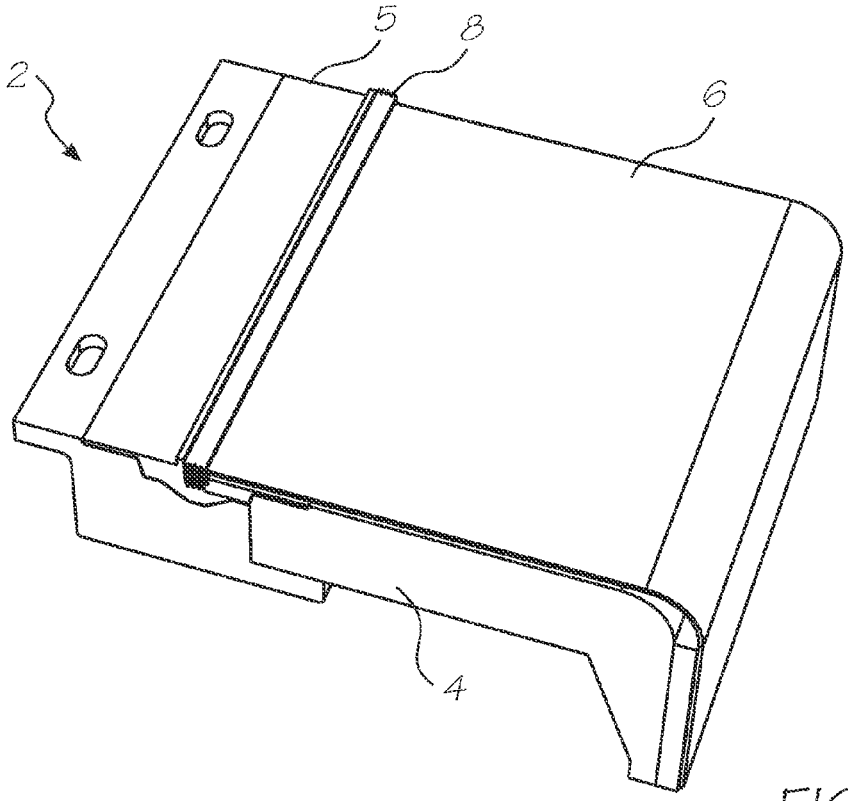
FIG. 8 is a perspective view showing the underside of a printhead module.
Figure 9:
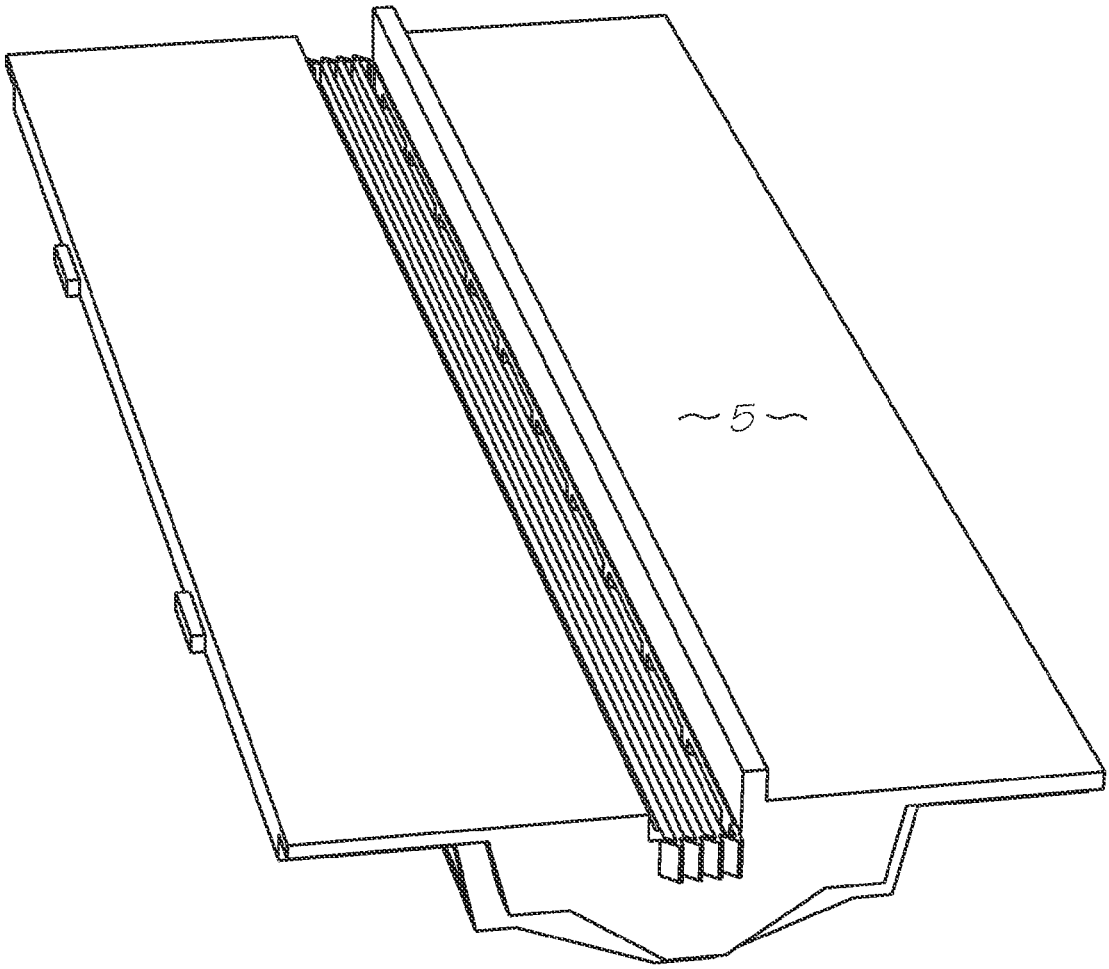
FIG. 9 shows a perspective view of the micro moulding that houses the printing chip in each printhead module.

Referring to FIGS. 7 to 9, the printhead modules (2) each comprise a printhead chip (8) bonded to a TAB (tape automated bond) film (6) accommodated and supported by a micro moulding (5), which is in turn adapted to mate with the cover moulding (4). The printhead chip (8) is typically a micro electro mechanical system(s) (MEMS) device.

The present invention will now be described with particular reference to the Applicant's MEMJET™ technology, various aspects of which are described in detail in the cross referenced documents. It will be appreciated that MEMJET™ is only one embodiment of the invention and used here for the purposes of illustration only. It is not to be construed as restrictive or limiting in any way on the extent of the broad inventive concept.

A MEMJET™ printhead is composed of a number of identical printhead modules (2) described in greater detail below. A MEMJET™ printhead is a drop-on-demand 1600 dpi inkjet printer that produces bi-level dots in up to 6 colors to produce a printed page of a particular width. Since the printhead prints dots at 1600 dpi (dots per inch), each dot is approximately 22.5 μm in diameter, and the dots are spaced 15.875 μm apart. Because the printing is bi-level, the input image is typically dithered or error-diffused for best results.

The modules (2) are designed such that the printhead chips (8) of adjacent modules can exactly abut one another so that there are no gaps or overlap in the printing produced. To achieve this, the modules (2) must be precisely aligned with each other after being mounted on the metal chassis (1).

Aligning the modules (2) using digital control of the chips (8) is possible but relatively difficult and costly given the complex manipulation of the print data necessary to seamlessly join the printing from adjacent modules. The required degree of alignment can be cost effectively provided by the mechanical adjustment mechanism of the present invention.

Figure 3:
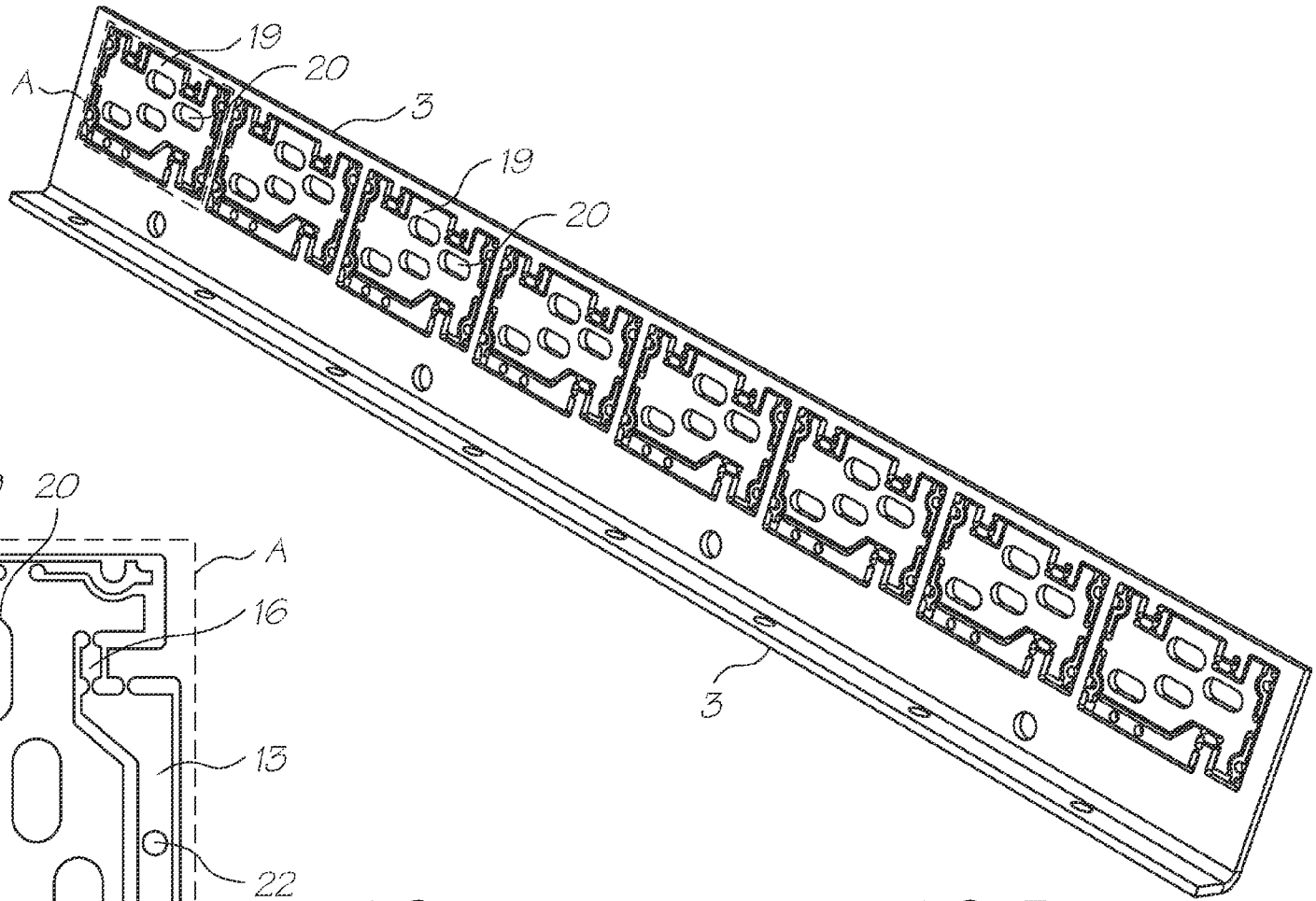
FIG. 3 is a perspective view of the support frame for the modular printhead shown in FIG. 1.
Figure 4:
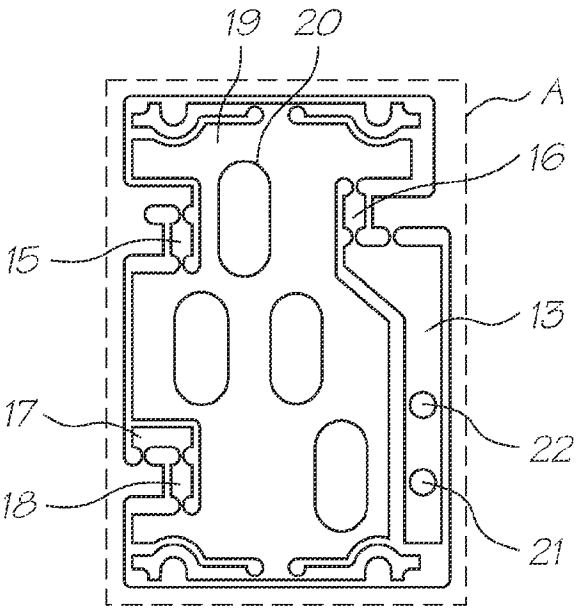
FIG. 4 is a plan view of the adjustment mechanism for one of the printhead modules shown in FIG. 1.
Figure 5:
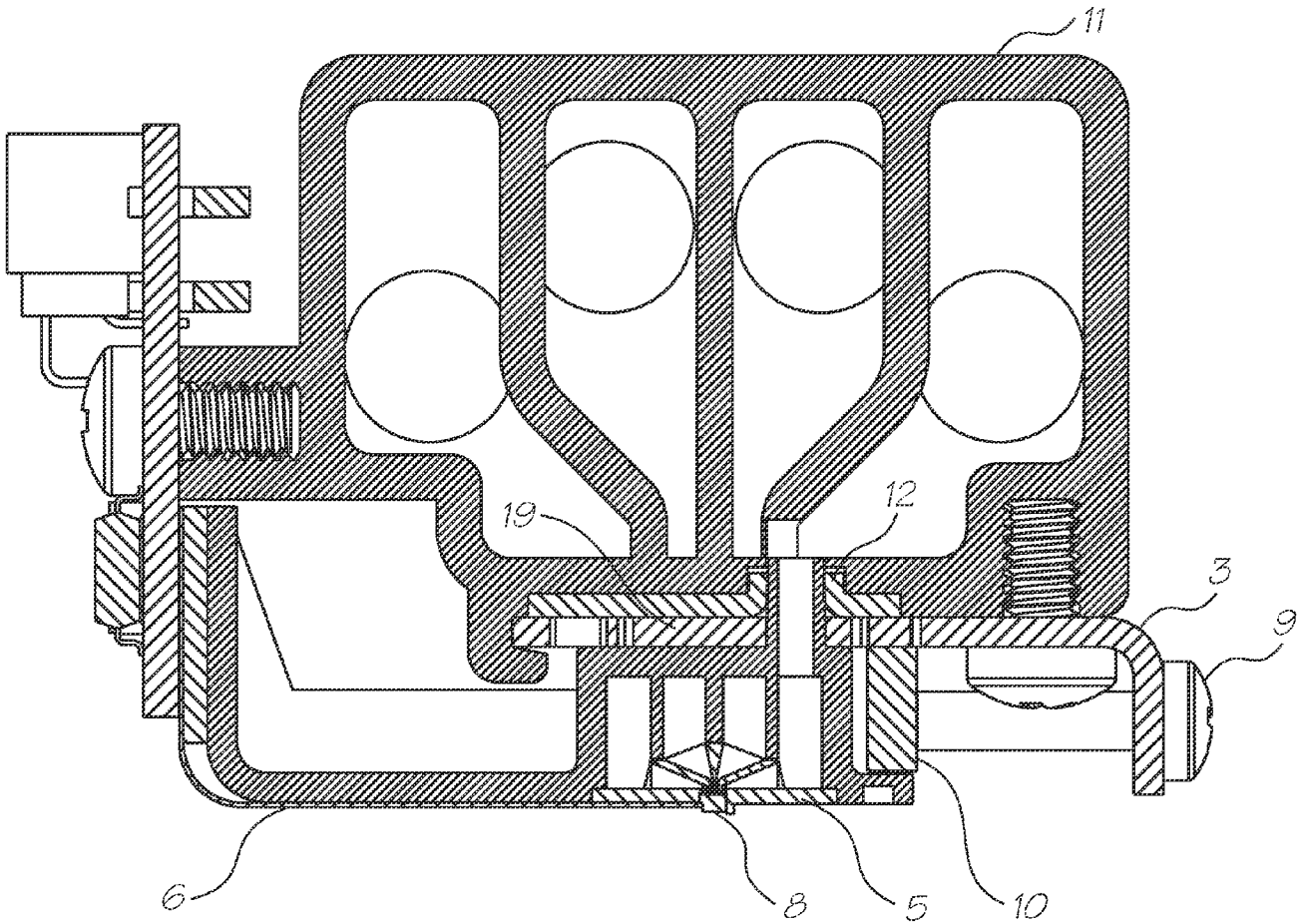
FIG. 5 is a cross-sectional view of the modular printhead shown in FIG. 1.
Figure 6:
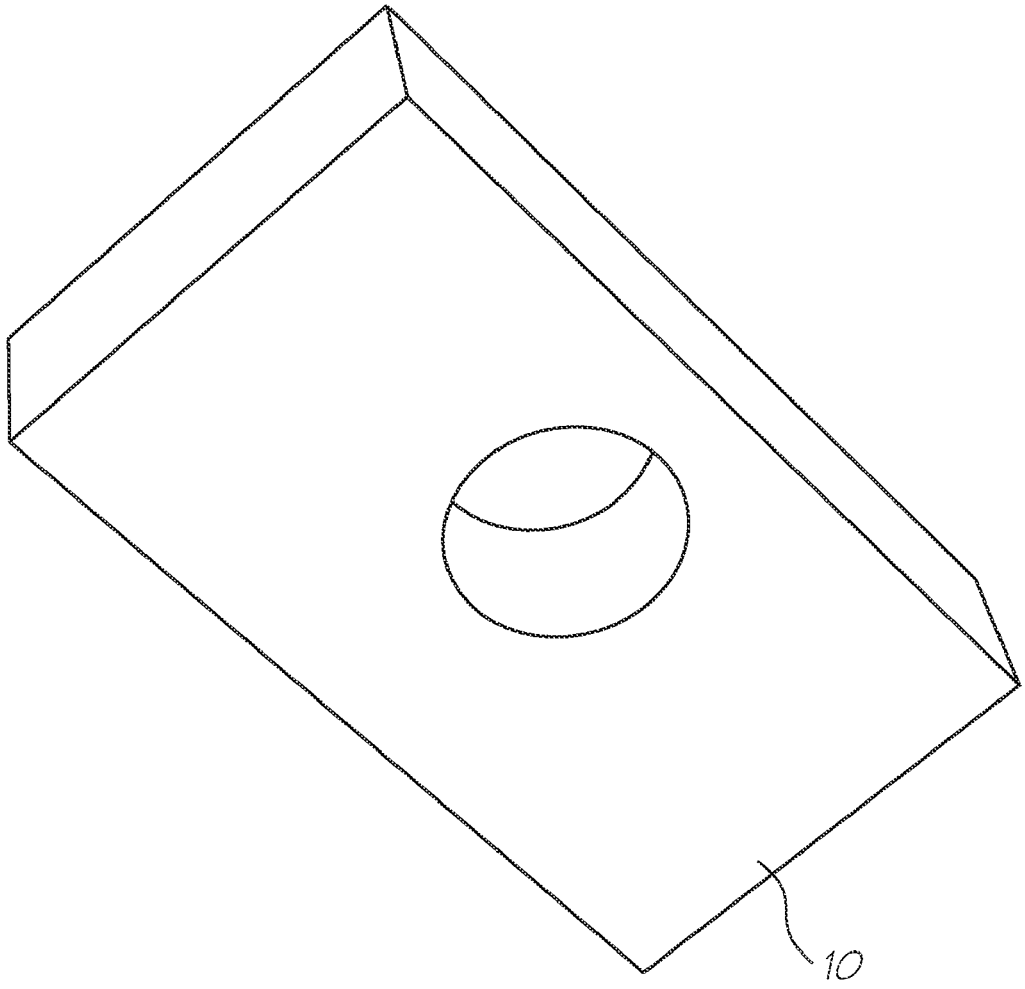
FIG. 6 is a perspective view of the adjuster block shown in FIG. 2.

Referring to FIGS. 3 and 4, the apertures (20) in the module engagement plate (19) receive the ink funnels for each module (2). The engagement plate (19) is integrally formed with the metal chassis (3) via hinged arms (15, 16, 17 & 18). Input lever (13) is fulcrumed against the metal chassis (3) to act on the engagement plate (19) via the hinged link arm (16). Movement of the input lever (13) is reduced by the lever arms to produce a minute movement of the engagement plate (19).

By careful configuration of the input lever (13) and the hinged link arms (15, 16, 17 & 18), the resultant movement in the engagement plate (19) is substantially linear and parallel to the longitudinal axis of the metal chassis (3). The skilled artisan will readily appreciate that it is convenient to configure the input lever (13) and the hinged link arms (15, 16, 17 & 18) such that input movement is substantially normal to the resultant movement for ease of access to the input lever (13).

The apertures (21, 22) in each of the input levers (13) are used to fit any convenient intermediate integer (not shown) selected for applying the input force to their respective input lever (13).

Referring to FIG. 2, the intermediate integers chosen for the present embodiment are a series of adjuster blocks (10) individually fixed to each of the input levers. Grub screws (9) threadedly engaged with the metal chassis (3) to bear against each of the adjuster block (10).

This arrangement allows precise alignment of the modules (2) by reducing the axial input motion of the grub screw (9) by ratio of about 1000 to 1 to produce minute movement of the engagement plate (19) with respect to the metal chassis (3).

The invention has been described herein by way of example only. Skilled workers in this field will readily recognise many variations and modifications that do not depart from the spirit and scope of the broad inventive concept.

I claim:

1. A modular printhead comprising:

a chassis;

a plurality of printhead modules mounted in the chassis;

a plurality of alignment mechanisms each corresponding to a respective printhead modules, each alignment mechanism interposed between the chassis and a respective printhead module and including a lever provided on a first side of a fulcrum point and a printhead module engagement plate coupled to the lever at a second side of the fulcrum point;

a plurality of adjuster blocks corresponding to respective alignment mechanisms, each adjuster block engaged with respective levers via an aperture defined through each lever; and a plurality of adjustment mechanisms corresponding to respective adjuster blocks, each adjustment mechanism coupled to the chassis at one end and to a respective adjuster block at another end, wherein the lever and the printhead module engagement plate are formed as a unitary piece, and each alignment mechanism further includes a number of hinged arms facilitating linear and parallel movement of the engagement plate in a direction towards and away from adjacent printhead modules in response to operation of the adjustment mechanism, and the aperture is defined through the lever perpendicular to a major plane of the engagement plate.

2. A modular printhead according to claim 1, wherein each adjuster block is engaged with respective levers perpendicularly to the major plane of the engagement plate.

3. A modular printhead according to claim 2, wherein each adjustment mechanism extends parallel to a major plane of the engagement plate.

4. A modular printhead according to claim 3, wherein each adjustment mechanism is adapted to move respective levers in a direction orthogonal to a longitudinal axis of the chassis.

* * * * *